US009670804B2

(12) United States Patent
Mukouhara et al.

(10) Patent No.: US 9,670,804 B2
(45) Date of Patent: Jun. 6, 2017

(54) OIL PASSAGE OF INTERNAL COMBUSTION ENGINE

(71) Applicant: HONDA MOTOR CO., LTD., Tokyo (JP)

(72) Inventors: Hodaka Mukouhara, Wako (JP); Hiroyuki Sugiura, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/225,577

(22) Filed: Mar. 26, 2014

(65) Prior Publication Data

US 2014/0290620 A1 Oct. 2, 2014

(30) Foreign Application Priority Data

Mar. 29, 2013 (JP) ..... 2013-072911

(51) Int. Cl.

| | |
|---|---|
| ***F02B 75/00*** | (2006.01) |
| ***F01M 11/02*** | (2006.01) |
| ***F01M 1/08*** | (2006.01) |
| ***F01M 13/04*** | (2006.01) |

(52) U.S. Cl.

CPC ..... *F01M 11/02* (2013.01); *F01M 1/08* (2013.01); *F01M 13/04* (2013.01); *F01M 2013/0461* (2013.01)

(58) Field of Classification Search

CPC ..... F01M 1/08; F01M 11/02; F01M 13/00; F01M 13/0416; F01M 13/04; F02M 35/10222; F01P 3/08; F01P 3/10; F01P 3/06

USPC ..... 123/195 AC, 41.34, 41.35, 54.4, 314, 123/90.38, 196 R

See application file for complete search history.

(56) References Cited

U.S. PATENT DOCUMENTS

| | | | | |
|---|---|---|---|---|
| 5,647,337 | A * | 7/1997 | Johnson | F02M 25/06 123/572 |
| 2006/0157004 | A1* | 7/2006 | Gunji | F01L 1/022 123/54.4 |
| 2007/0240692 | A1* | 10/2007 | Takahashi | F01M 11/02 123/572 |

FOREIGN PATENT DOCUMENTS

| | | | |
|---|---|---|---|
| JP | 2003-106132 | A | 4/2003 |

* cited by examiner

*Primary Examiner* — Hung Q Nguyen
*Assistant Examiner* — Omar Morales
(74) *Attorney, Agent, or Firm* — Birch, Stewart, Kolasch & Birch, LLP

(57) ABSTRACT

An oil passage of an internal combustion engine including a crankcase, a cylinder block integrally connected to the crankcase, a piston operatively mounted within the cylinder block, a piston jet for providing oil to the piston within the cylinder block and a breather device integrally formed on the cylinder block wherein the breather device is in communication with the inside of the crankcase. An elevation of temperature of the oil which flows in an oil supply path is prevented thus allowing oil in the oil supply path to maintain a low temperature wherein the oil in the supply path is supplied to a piston jet formed on the internal combustion engine. An oil supply path through which oil is supplied to the piston jet is integrally formed on a wall body exposed to ambient air on a peripheral wall which forms the breather device.

14 Claims, 9 Drawing Sheets

OIL PASSAGE OF INTERNAL COMBUSTION ENGINE

CROSS-REFERENCE TO RELATED APPLICATIONS

The present application claims priority under 35 USC 119 to Japanese Patent Application No. 2013-072911 filed Mar. 29, 2013 the entire contents of which are hereby incorporated by reference.

BACKGROUND OF THE INVENTION

1. Field of the Invention

The present invention relates to an oil passage formed in a crankcase of an internal combustion engine.

2. Description of Background Art

A V-type internal combustion engine is known wherein an oil supply path to a piston jet for injecting oil into a piston is formed in a bottom portion inside a V-shaped bank. In this prior art, a breather device is arranged such that the breather device covers an upper side of the oil supply path. Thus, oil which passes through the oil supply path is brought into a state where the temperature of the oil is liable to be elevated by heat transferred from a cylinder. At the same time, the oil supply path is brought into a state where the oil supply path is covered with the breather so that the temperature of oil is maintained. As a result, high temperature oil is supplied to the piston jet. See, for example, JP-A-2003-106132. In view of the cooling the piston, it is desirable that oil supplied to the piston jet is supplied such that the elevation of the oil temperature is suppressed as much as possible. Also in the case where a breather and an oil supply path are provided in the vicinity of the cylinder, there has been a demand for a structure that can maintain oil in the oil supply path at a low temperature.

SUMMARY AND OBJECTS OF THE INVENTION

It is an object of an embodiment of the present invention to provide a structure for maintaining oil inside an oil supply path at a low temperature by preventing the elevation of the temperature of oil which flows in the oil supply path for supplying oil to a piston jet mounted in an internal combustion engine.

According to an embodiment of the present invention, an oil passage of an internal combustion engine (1), the internal combustion engine (1) includes:

a crankcase (2);

a cylinder block (3F,3R) that is integrally connected to the crankcase (2);

a piston (12) that is housed in the cylinder block (3F,3R);

a piston jet (53) that is provided to the cylinder block (3F,3R) for supplying oil in the internal combustion engine (1) to the piston (12); and a breather device (30) that is integrally formed on the cylinder block (3F,3R) such that the breather device (30) is in communication with the inside of the crankcase (2), wherein an oil supply path (50) through which oil is supplied to the piston jet (53) is integrally formed on a wall body exposed to outside air of a peripheral wall which forms the breather device (30).

According to an embodiment of the present invention, a plurality of cylinders (4) mounted in the cylinder blocks (3F,3R) are arranged such that the cylinders (4) form a pair in the longitudinal direction and form a V-shaped bank, the breather device (30) is formed in a valley portion of the V-shaped bank, and the oil supply path (50) to the piston jet (53) is formed in a ceiling wall (33) of the breather device (30).

According to an embodiment of the present invention, a recessed portion (36) is formed on an outer surface of the ceiling wall (33) of the breather device (30), and the oil supply path (50) is integrally formed on a lower side of the recessed portion (36).

According to an embodiment of the present invention, a plurality of piston jet branched oil passage (54) each having a small diameter for supplying oil to a respective piston jet (53) are formed traversing the inside of the breather device (30) from the oil supply path (50) in a downward direction.

According to an embodiment of the present invention, a journal lubrication oil passage (56) extends toward a journal (55) for a crankshaft (10) of the internal combustion engine (1) that is branched from the oil supply path (50), and traverses the inside of the breather device (30) in a downward direction.

According to an embodiment of the present invention, a plurality of journal lubrication oil passages (56) extending toward the plurality of journals (55) for the crankshaft (10) are provided in a branched manner from the oil supply path (50). A piston jet branched oil passage (54) extending toward the piston jet (53) is also branched from the oil supply path (50) in a spaced-apart manner from the journal lubrication oil passage (56).

According to an embodiment of the present invention, a first oil supply path (51) through which oil is supplied from one end side of the oil supply path (50) is connected to the oil supply path (50). A second oil supply path (52) having a smaller diameter than the first oil supply path (51) is connected to a portion of the oil supply path (50) close to the other end of the oil supply path (50).

According to an embodiment of the present invention, between positions where the plurality of journal lubrication oil passages (56) extending toward the journal (55) from the oil supply path (50) are branched, the second oil supply path (52) is connected in a form that the second oil supply path (52) intersects a side portion of the oil supply path (50).

According to an embodiment of the present invention, the breather device (30) is integrally formed on the cylinder block (3F,3R), and the oil supply path (50) through which oil is supplied to the piston jet (53) is integrally formed in the wall body exposed to outside air of the peripheral wall of the breather device (30). Accordingly, not only the oil supply path (50) can be separated from cylinder (4), but also there is no possibility that the oil supply path (50) is surrounded by the cylinder (4) and the breather device (30). Thus, a temperature maintaining action by the breather device (30) can be lowered and hence, the elevation of the temperature of oil in the oil supply path (50) can be lowered whereby oil having an oil temperature lower than conventional oils can be supplied to the piston jet (53) whereby cooling performance can be enhanced.

According to an embodiment of the present invention, the oil supply path (50) and the breather device (30) are integrally formed on the valley portion of the V-shaped bank, and the oil supply path (50) is formed in the ceiling wall (33) of the breather device (30). Thus, the oil supply path (50) can be spaced apart from the cylinder (4) whereby the thermal effect from the cylinder (4) on the oil supply path (50) can be lowered, and at the same time, oil supply path (50) is exposed to outside air thus suppressing the elevation of the oil temperature by cooling.

According to an embodiment of the present invention, the oil supply path (50) is integrally formed directly below the recessed portion (36) formed on an outer surface of the ceiling wall (33). Thus, a surface area which is exposed to outside air is increased thus enhancing heat radiation property.

According to an embodiment of the present invention, a plurality of piston jet branched oil passages (54) are provided having a small diameter and are formed such that the piston jet branched oil passages (54) extend toward the piston jet (53) while traversing the inside of the breather device (30) downward from the oil supply path (50). Accordingly, by branching the flow of oil from the oil supply path (50), the elevation of the oil temperature in the oil supply path (50) can be suppressed.

According to an embodiment of the present invention, the journal lubrication oil passage (56) through which oil is supplied to the journal (55) for the crankshaft (10) from the oil supply path (50) arranged in the ceiling wall (33) of the breather device (30) is formed such that journal lubrication oil passage (56) traverses the breather device (30). Thus, the journal lubrication oil passage (56) can be provided with a shortest path.

According to an embodiment of the present invention, the journal lubrication oil passage (56) which extends toward the journal (55) and the piston jet branched oil passage (54) which extends toward the piston jet (53) are branched from the common oil supply path (50) in a spaced-apart manner from each other and hence, portions of the oil passages can be used in common whereby the oil passages can be shortened and simplified.

According to an embodiment of the present invention, the plurality of oil supply paths are connected to the oil supply path (50). Thus, when the supply of oil from the first oil supply path (51) becomes short, oil can be supplied also from the second oil supply path (52). Accordingly, it is possible to avoid a situation where the oil supply to the journal (55) for the crankshaft (10) and the piston jet (53) becomes short.

According to an embodiment of the present invention, the second oil supply path (52) is connected to the oil supply path (50) between the branching positions of the plurality of lubrication oil passages (56) extending toward the journals (55). Accordingly, while it is necessary to increase an amount of oil toward the journal (55) on the downstream side of the oil supply path (50), such oil can be also supplied from the second oil supply paths (52). Thus, the oil shortage can be avoided.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
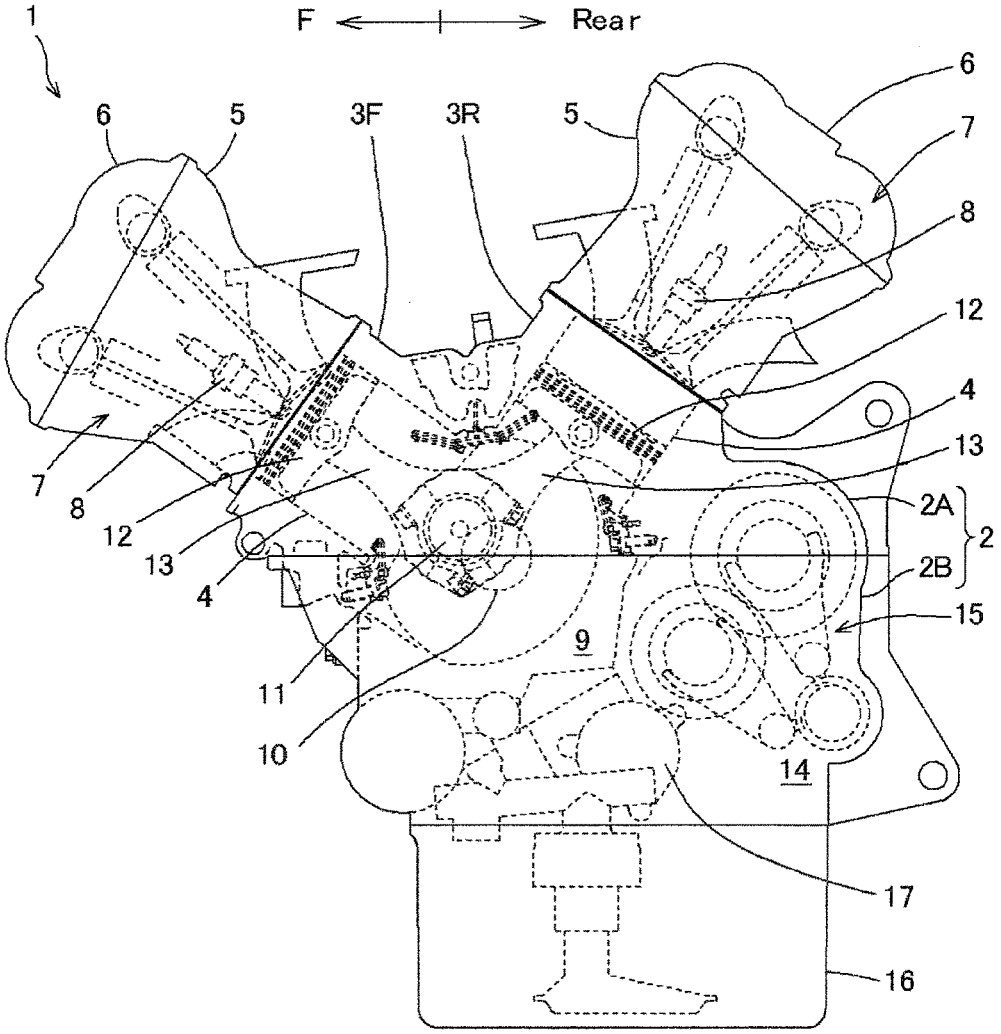
FIG. 1 is a left side view of a V-type 4-cylinder 4-cycle internal combustion engine for mounting on a motorcycle according to one embodiment the invention.

FIG. 1 is a left side view of a V-type 4-cylinder 4-cycle internal combustion engine for mounting on a motorcycle according to one embodiment the invention. An arrow F indicates a front side in a state where the internal combustion engine 1 is mounted on a vehicle, and an arrow Rear indicates a rear side in a state where the internal combustion engine 1 is mounted on the vehicle. A center portion of the internal combustion engine 1 is occupied by a crankcase 2. The crankcase 2 is constituted of an upper crankcase 2A and a lower crankcase 2B. The upper crankcase 2A includes a front cylinder block 3F and a rear cylinder block 3R which are integrally formed. The front cylinder block 3F and the rear cylinder block 3R include two cylinders 4 respectively. A cylinder head 5 is fastened to upper end surfaces of the front cylinder block 3F and the rear cylinder block 3R, and a cylinder head cover 6 is fastened to upper end surfaces of the cylinder heads 5, respectively. An upper end surface of the lower crankcase 2B is fastened to a lower end surface of the upper crankcase 2A thus forming the integral crankcase 2. In the inside of the cylinder head 5 and the cylinder head cover 6, a valve operating mechanism 7 and an ignition plug 8 are arranged corresponding to the respective cylinders 4.

A front half portion of the inside of the crankcase 2 defines a crank chamber 9. A crankshaft 10 is rotatably supported in a state where the axis of rotation is positioned on a mating surface between the upper and lower crankcases 2A, 2B. Two left and right crank pins 11 are mounted on the crankshaft 10. Two pistons 12 on a front side and two pistons 12 on a rear side are connected to the crank pins 11 by way of connecting rods 13, respectively.

A transmission chamber 14 is defined in a rear half portion of the inside of the crankcase 2, and a constant-mesh-gear transmission 15 is housed in the transmission chamber 14. An oil pan 16 is fastened to a lower end surface of the lower crankcase 2B. An oil pump 17 and the like are mounted on a lower portion of the lower crankcase 2B, and lubrication oil is supplied to respective parts of the internal combustion engine 1.

Figure 2:
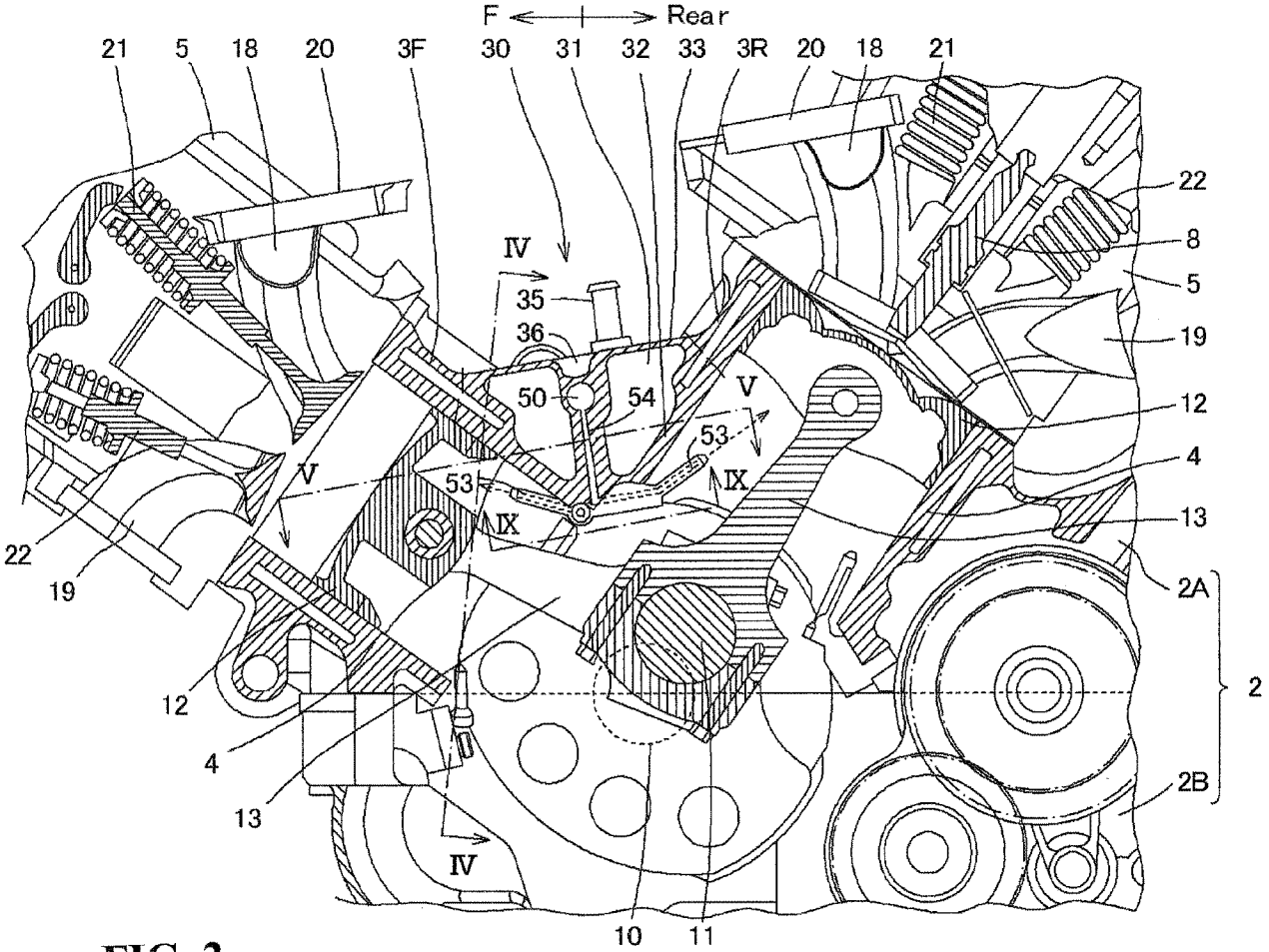
FIG. 2 is an enlarged cross-sectional view of an essential part of the internal combustion engine.

FIG. 2 is an enlarged cross-sectional view of an essential part of the internal combustion engine 1.

The piston 12 is slidably fitted into the respective front and rear cylinders 4. The crankshaft 10 is pivotally supported on the mating surface between the upper crankcase 2A and the lower crankcase 2B. Both ends of the connecting rod 13 are pivotally mounted on the crankpin 11 and the piston 12, and the crankshaft 10 is rotatably driven corresponding to the upward and downward movement of the piston 12. A piston jet which injects oil to a slide portion of the piston is formed on a lower portion of each cylinder block. Oil to be injected is supplied from an oil supply path.

An intake port 18 is arranged on respective sides of the cylinder heads 5 where lower portions of the front and rear cylinder heads 5 approach to each other respectively, and an exhaust port 19 is arranged on front and rear outer sides of the front and rear cylinder heads 5, respectively. A throttle body connection member 20 is mounted on an upper portion of the intake port 18. An intake valve 21 is mounted on the intake port 18 in an openable and closable manner, and an exhaust valve 22 is mounted on the exhaust port 19 in an openable and closable manner.

A breather device 30 is arranged at a valley portion of a V-shaped bank sandwiched between the front and rear cylinder blocks 3F, 3R which is also a portion positioned on an upper surface of the crankcase 2. A breather chamber 31 is formed in the inside of the breather device 30. A peripheral wall of the breather chamber 31 excluding a ceiling wall 33 is formed commonly with portions of the front and rear cylinder blocks 3F, 3R and a portion of the upper crankcase 2A.

More specifically, the breather chamber 31 is formed by the bottom wall 32, the ceiling wall 33 and side walls 34 (FIG. 5), wherein the bottom wall 32 is integrally and commonly formed of lower end portions of the plurality of cylinders 4 formed in a V shape, the ceiling wall 33 is integrally formed above the bottom wall 32 with the plurality of cylinders formed into a V shape in a state where the ceiling wall 33 straddles over the plurality of cylinders, and the side walls 34 which form the breather chamber 31 by closing both end portions of a space defined in the crankshaft 10 direction between the plurality of cylinders 4 formed in a V shape.

A breathing gas discharge pipe 35 is mounted in an erected manner on the ceiling wall 33 of the breather chamber 31. A water drain groove 36 is formed on the ceiling wall 33 adjacent to the breathing gas discharge pipe 35. An oil supply path 50 is provided directly below the water drain groove 36. A piston jet 53 which injects oil to the slide portion of the piston 12 is formed on a lower portion of each cylinder 4. Oil to be injected is supplied from the above-mentioned oil supply path 50.

Figure 3:
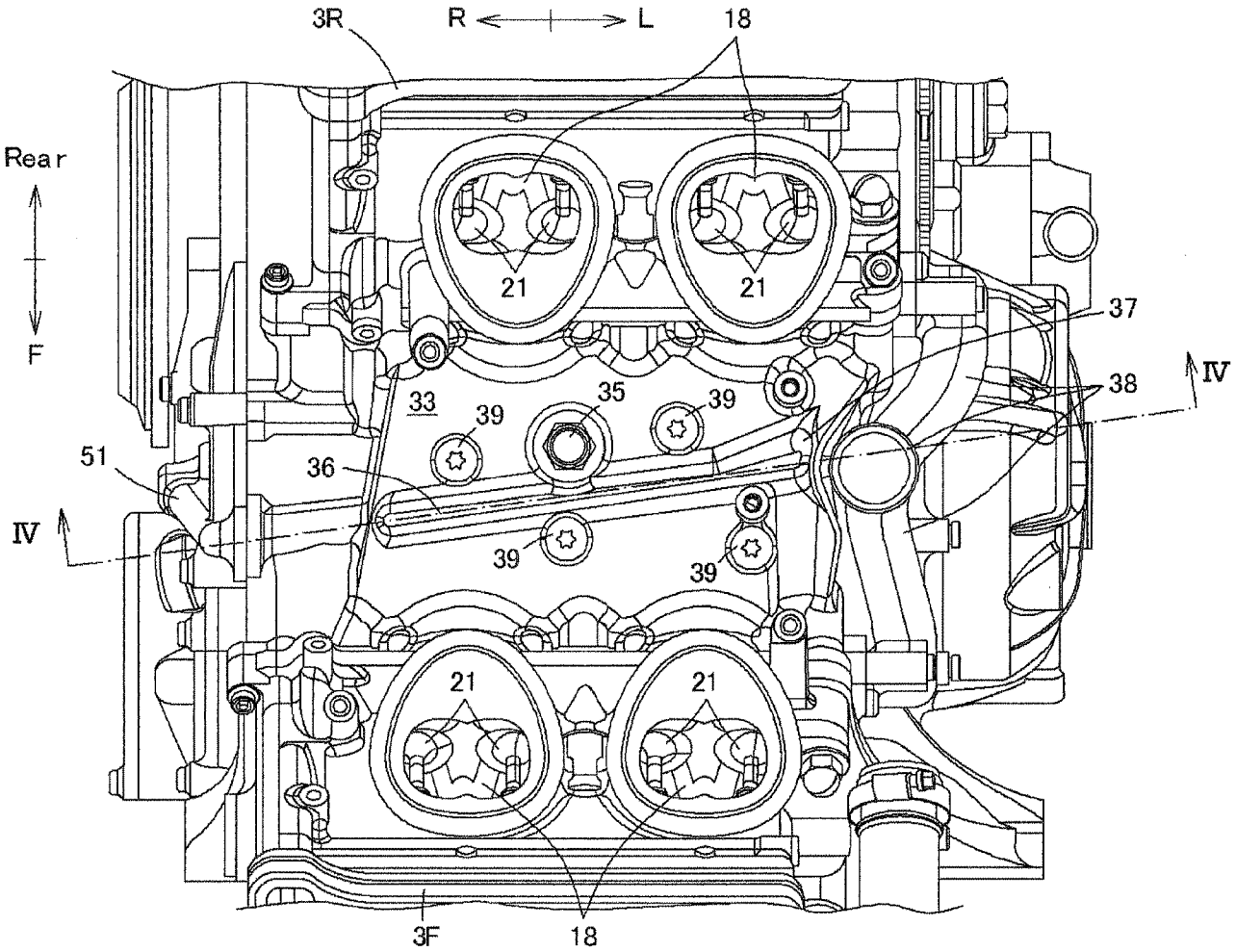
FIG. 3 is a view of an upper surface of a breather device as viewed from above the internal combustion engine.

FIG. 3 is a view showing an upper surface of the breather device 30 as viewed from above the internal combustion engine 1. In FIG. 3, two intake ports 18 corresponding to two cylinders 4 formed on the front cylinder block 3F and two intake ports 18 corresponding to two cylinders 4 formed on the rear cylinder block 3R are shown. Although one cylinder is provided with two intake valves 21 and two exhaust valves 22, only two intake valves 21 arc shown in the drawing with respect to each intake port. The breathing gas discharge pipe 35, the water drain groove 36, a drain hole 37 and closure plugs 39 are mounted on an upper surface of the ceiling wall 33. A cooling water pipe 38 for cooling the cylinder 4 is provided on a left side of the internal combustion engine. The breathing gas discharge pipe 35 and the water drain groove 36 are also shown in FIG. 2. A groove bottom of the water drain groove 36 is formed such that the groove bottom is high on a right side and is gradually lowered toward a left side. The drain hole 37 is formed adjacent to the lowest position of the groove bottom.

The breathing gas discharge pipe 35 is mounted in a breathing gas discharge pipe mounting hole formed in the ceiling wall 33. The breathing gas discharge pipe 35 is a sleeve provided for feeding an unburned gas separated by the breather device 30 toward an air cleaner (not shown in the drawing) through a hose (not shown in the drawing). The fed unburned gas is again supplied to the internal combustion engine 1 together with air and is burned.

The closure plugs 39 are provided for closing core takeout through holes formed in the ceiling wall 33 of the breather chamber 31 for taking out core sands used for forming the breather chamber 31 at the time of forming the breather chamber 31 integrally with the upper crankcase 2A by casting.

Figure 4:
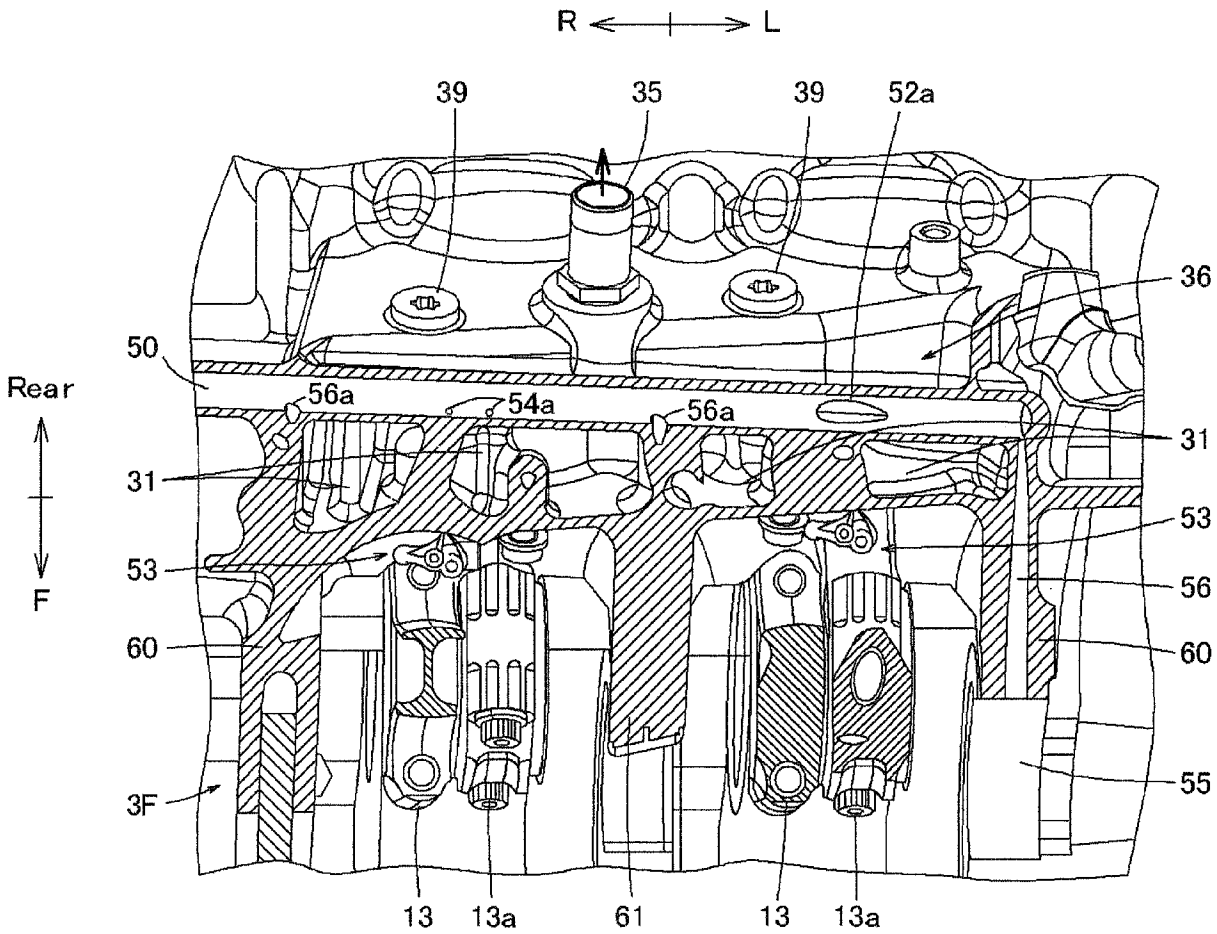
FIG. 4 is a cross-sectional view taken along a line IV-IV in FIG. 2 and FIG. 3.

FIG. 4 is a cross-sectional view taken along a line IV-IV in FIG. 2 and FIG. 3. In a cross section of the left and right cylinders 4 included in the front cylinder block 3F, a cross section of the front connecting rod 13 and a large end portion 13*a* of the rear connecting rod 13 are shown. The oil supply path 50 is integrally formed with the ceiling wall 33 of the breather device 30 adjacent to a lower side of the water drain groove 36 (recessed portion) formed on an outer surface of the ceiling wall 33. The groove bottom of the water drain groove 36 is formed such that the groove bottom is low on a left side. Accordingly, the oil supply path 50 is also formed such that the oil supply path 50 is low on a left side. The oil supply path 50 is an oil passage for supplying oil to a plurality of journals 55 for a plurality of piston jets 53 and the crankshaft 10. The oil supply path 50 is formed integrally with the ceiling wall 33 directly below the water drain groove 36 formed on the outer surface of the ceiling wall 33. Thus, a surface area exposed to the outside air is increased. Accordingly, heat radiation property can be enhanced. Thus, oil can be maintained at a low temperature. The piston jets 53 are shown in the cross section of the front cylinder block 3F in FIG. 4.

Figure 5:
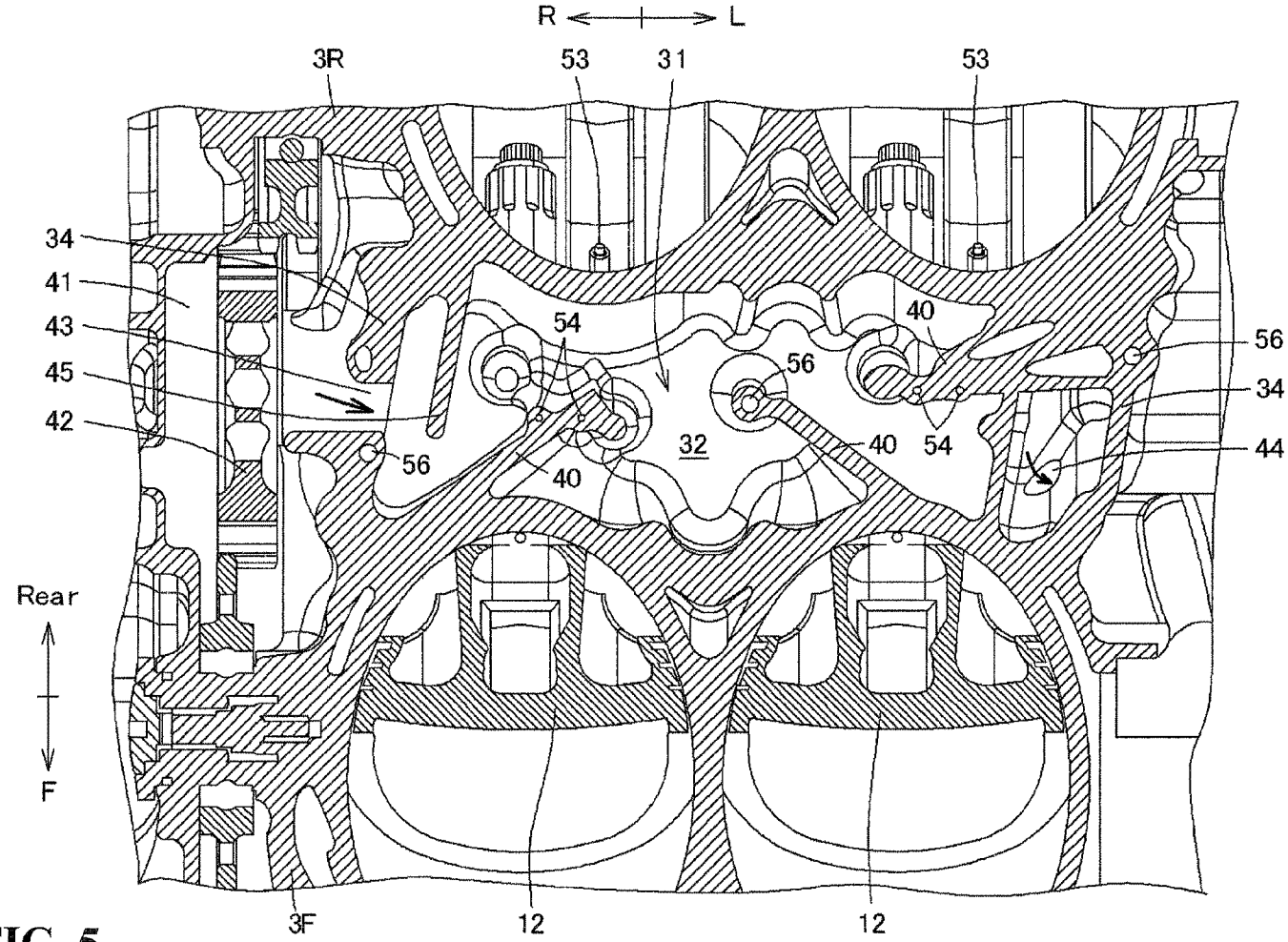
FIG. 5 is a cross-sectional view taken along a line V-V in FIG. 2.

FIG. 5 is a cross-sectional view taken along a line V-V in FIG. 2. In the drawing, a lower portion and the bottom wall 32 of the breather chamber 31, a cross section of the front and rear cylinder blocks 3F, 3R, and a cross section of the front piston 12 are shown. Distal end portions of the piston jets 53 are shown in the cross section of the rear cylinder block 3R. A plurality of labyrinth walls 40 for forming a labyrinth in the inside of the breather chamber 31 are formed in an erected manner on the bottom wall 32 of the breather chamber 31.

A gear train chamber 41 which houses a gear train is formed in a right end portion of the internal combustion engine 1. The gear train is provided for driving a cam shaft of the valve operating mechanism 7 by making use of the rotation of the crankshaft 10. A drive gear 42 is illustrated which is mounted on the crankshaft 10 and constitutes a start point of the gear train. The gear train chamber 41 is communicated with the crank chamber 9.

The inside of the crank chamber 9 is filled with a blow-by gas. A main component of the blow-by gas is an unburned gas. The inside of the crank chamber 9 is also filled with oil supplied to a rotation part in the form of an oil mist. The oil mist and the blow-by gas are mixed together thus forming an oil mixed blow-by gas. The oil mixed blow-by gas is introduced into the breather chamber 31 from the crank chamber 9 through the gear train chamber 41 and a breather chamber inlet port 43 and is subjected to gas/liquid separation. A separated unburned gas is discharged from the breathing gas discharge pipe 35 (FIG. 3, FIG. 4) and, as described previously, is returned to the internal combustion engine 1 through the air cleaner and is burned in the internal combustion engine 1. The separated oil is discharged to an AC generator chamber (not shown in the drawing) from the oil discharge port 44 and is returned to the oil pan 16 through the AC generator chamber.

An inlet baffle wall 45 is formed in an erected manner inside the breather chamber inlet port 43 in a state where the inlet baffle wall 45 partially overlaps with the breather chamber inlet port 43. Due to such a construction, it is possible to prevent oil supplied from the crankcase 2 from directly flowing into the breather chamber 31.

Figure 6:
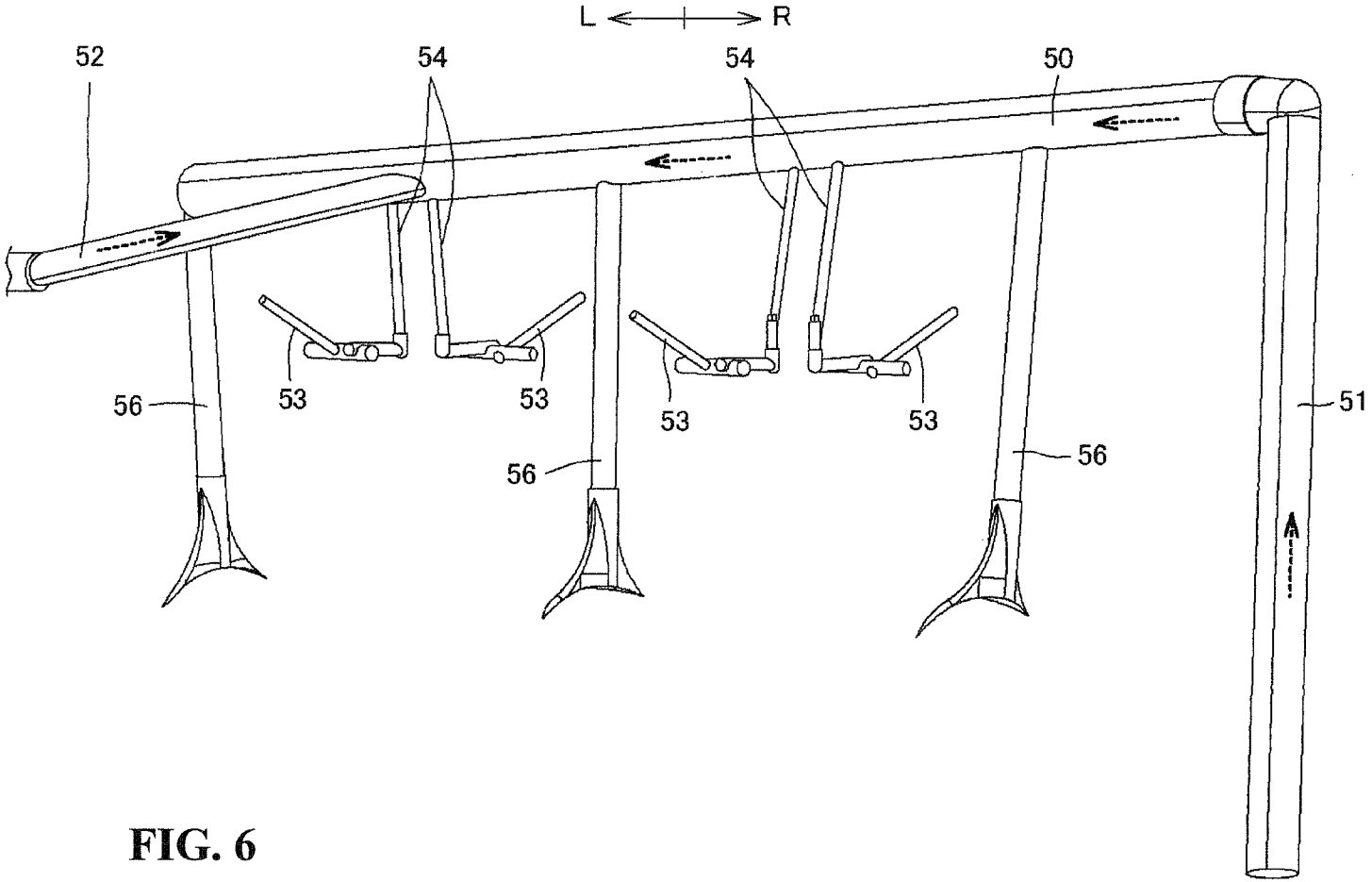
FIG. 6 is an arrangement view of an oil supply path and various oil passages connected with the oil supply path as a prospective view as viewed from behind the internal combustion engine.

FIG. 6 is a view of the oil supply path 50 and various oil passages connected with the oil supply path 50 as a perspective view as viewed from behind the internal combustion engine 1. A first oil supply path 51 through which oil is supplied to the oil supply path 50 is formed on a right end of the oil supply path 50. On the other hand, a second oil supply path 52 having a small diameter through which oil is supplied to the oil supply path 50 is connected to the oil supply path 50 in the vicinity of a left end of the oil supply path 50 in an obliquely intersecting manner. The main streams of oil in the oil passages are indicated by arrows. Since the first oil supply path 51 is the main oil supply path. Thus, a right side of the oil supply path 50 is an upstream side and a left side of the oil supply path 50 is a downstream side. As described previously, the oil supply path 50 is arranged adjacent to the position directly below the water drain groove 36. The groove bottom of the water drain groove 36 is lowered toward the left side. Accordingly, the oil supply path 50 is also formed such that the left side of the oil supply path 50 is low. That is, the groove bottom is formed such that the downstream side (left side) of the groove bottom is low.

The piston jet branched oil passages 54 extending toward the piston jets 53 (see FIG. 2) formed on lower ends of the cylinders 4 are arranged above the crank chambers 9 in such a manner that the piston jet branched oil passages 54 traverse the inside of the breather device 30 downwardly from the oil supply path 50. These piston jet branched oil passages 54 are formed on the labyrinth walls 40 of the breather device 30. In FIG. 4, piston jet branched oil passage inlets 54*a* at two positions are shown on a left side of the drawing. In FIG. 5, cross sections of the piston jet branched oil passages 54 at four positions in total are shown.

The plurality of piston jet branched oil passages 54 having a small diameter which extend toward the piston jets 53 are formed in such a manner that the piston jet branched oil passages 54 traverse the inside of the breather device 30 downward from the oil supply path 50. Both the oil supply paths and the piston jet branched oil passages 54 are cooled by outside air. A surface area of the oil passages is increased by forming the plurality of piston jet branched oil passages 54. Thus, oil is brought into contact with and is cooled by inner surfaces of the oil passages and therefore, the elevation of the oil temperature in the oil supply path 50 and the piston jet branched oil passages 54 can be suppressed.

Journal lubrication oil passages 56 which extend toward the journals 55 formed in the crankshaft 10 of the internal combustion engine 1 are formed such that the journal lubrication oil passages 56 are branched from three portions of the oil supply path 50 and traverse the inside of the breather device 30 downward respectively. Upper half portions of the journal lubrication oil passages 56 are formed in the left and right side walls 34 of the breather device 30 and in the labyrinth walls 40 at the center portion of the breather device 30. In addition, lower half portions of the journal lubrication oil passages 56 are formed on an outer wall body 60 of the crankcase 2 and a partition wall 61 formed between the cylinders 4. In FIG. 4, the journal 55 and the journal lubrication oil passage 56 through which oil is supplied to the journal 55 are shown on the right side of the drawing, and journal lubrication oil passage inlets 56*a* are shown at the center and on the left side of the drawing. In FIG. 5, the cross sections of the journal lubrication oil passages 56 provided at left and right sides and at the center are shown.

Figure 7:
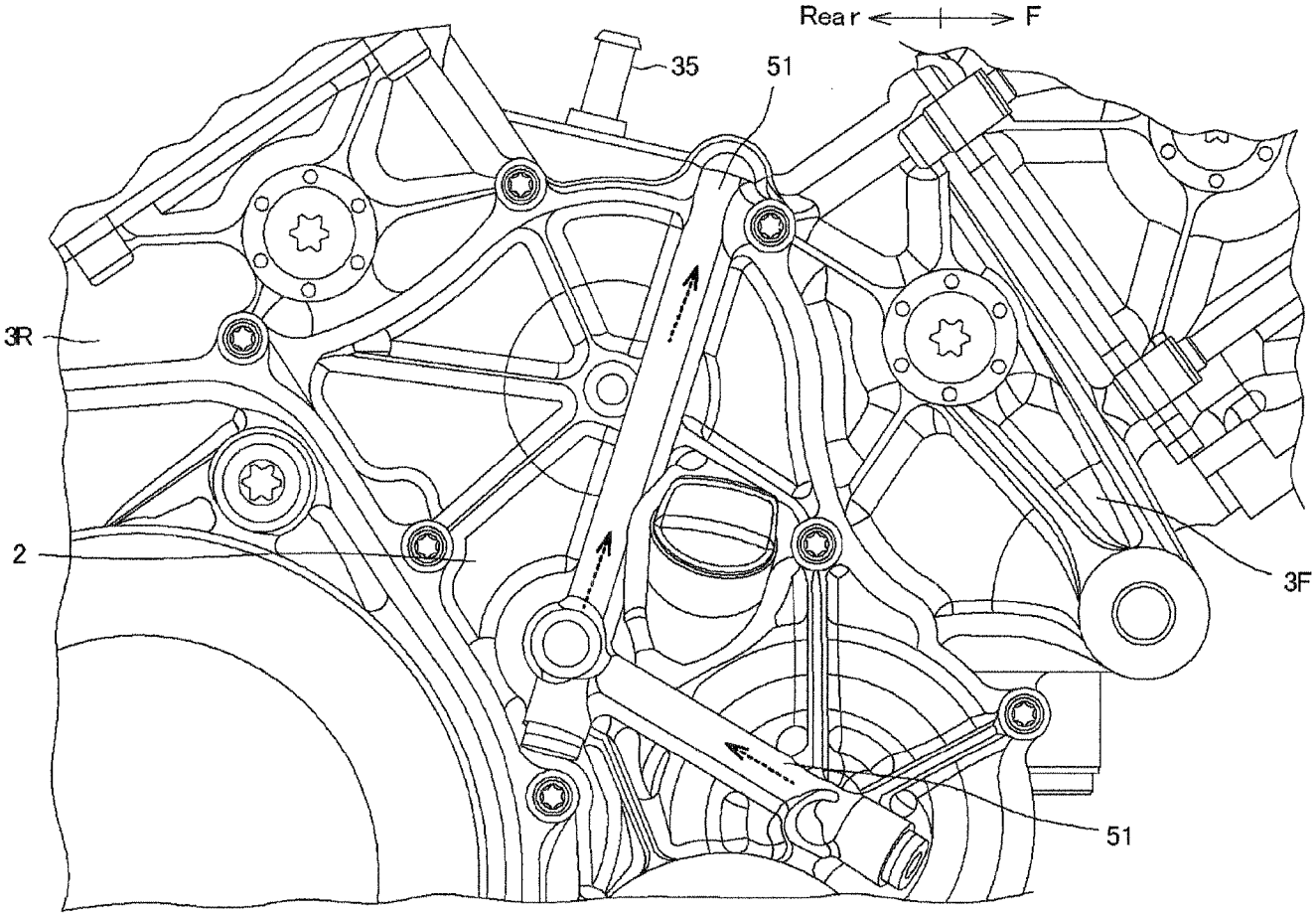
FIG. 7 is an external appearance view of a right surface of an essential part of the internal combustion engine.

FIG. 7 is an external appearance view of a right surface of an essential part of the internal combustion engine 1. The first oil supply path 51 is formed on a right outer surface of the crankcase 2. An upper end of the first oil supply path 51 is connected to a right end of the oil supply path 50 as shown in FIG. 6. A portion of the first oil supply path 51 is shown in the left end of FIG. 3.

Figure 8:
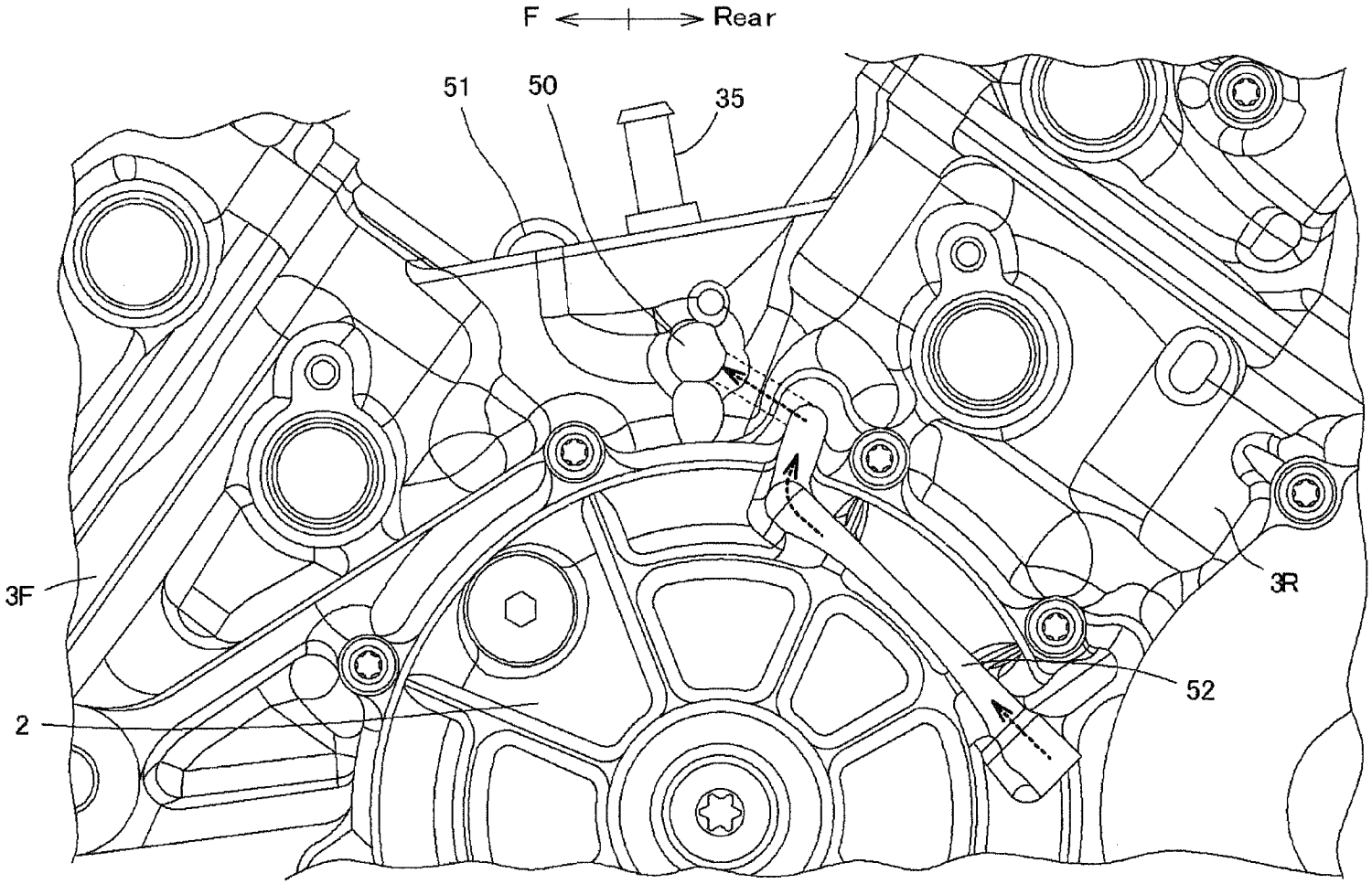
FIG. 8 is an external appearance view of a left surface of an essential part of the internal combustion engine.

FIG. 8 is an external appearance view of a left surface of an essential part of the internal combustion engine 1. The second oil supply path 52 having a smaller diameter than the first oil supply path 51 is formed on a left outer surface of the crankcase 2. As shown in FIG. 6, an upper end of the second oil supply path 52 is connected to the oil supply path 50 in an obliquely intersecting manner between the journal lubrication oil passage 56 on a left end side of the oil supply path 50 and the journal lubrication oil passage 56 on the center of the oil supply path 50. FIG. 4 shows an opening end 52*a* of the second oil supply path at the above-mentioned intersecting portion.

The plurality of oil supply paths are connected to the oil supply path 50. Thus, when oil supplied from the first oil supply path 51 becomes short, it is possible to supply oil also from the second oil supply path 52 whereby it is possible to obviate the situation where oil supplied to the journals 55 for the crankshaft 10 and the piston jets 53 becomes short. The second oil supply path 52 is connected to the oil supply path 50 between the branching positions of the plurality of lubrication oil passages extending toward the journals 55. Accordingly, while it is necessary to increase an amount of oil toward the journal 55 on the downstream side of the oil supply path 50, such oil can be also supplied from the second oil supply paths 52 and hence, the oil shortage can be avoided.

Figure 9:
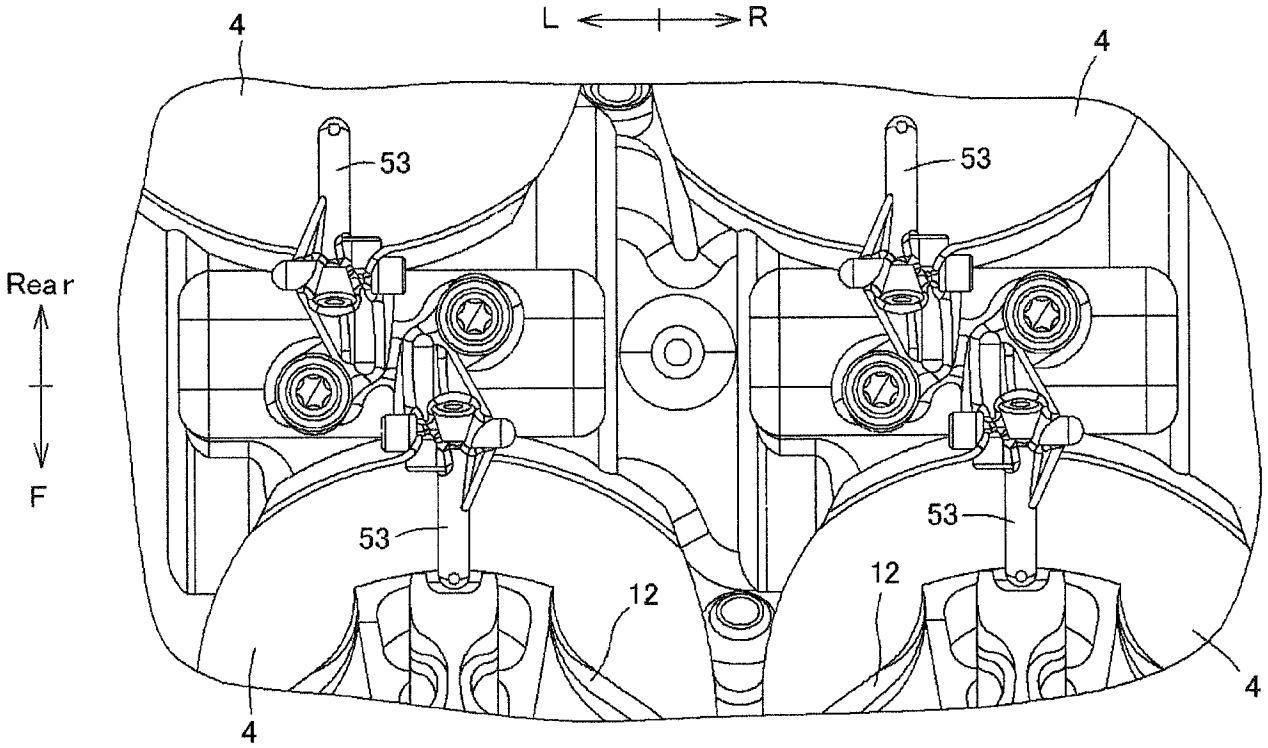
FIG. 9 is a cross-sectional view taken along a line IX-IX in FIG. 2, and is a view where a piston jet is viewed from a lower surface side.

FIG. 9 is a cross-sectional view taken along a line IX-IX in FIG. 2, wherein the piston jet 53 is viewed from a lower surface side. In FIG. 9, four sets of piston jets 53 are shown. As shown in FIG. 6, oil is supplied to the piston jets 53 through four piston jet branched oil passages 54 branched from the oil supply path 50.

As has been explained in detail heretofore, the above-mentioned embodiment can acquire the following advantageous effects.

(1) The breather device 30 is integrally formed on the cylinder blocks 3F, 3R, and the oil supply path 50 through which oil is supplied to the piston jet 53 is integrally formed in the wall body exposed to outside air of the peripheral wall of the breather device 30. Accordingly, oil having a lower oil temperature than conventional oil can be supplied to the piston jet 53.

(2) The oil supply path 50 is formed in the ceiling wall 33 of the breather device 30. Thus, the elevation of the oil temperature can be suppressed by cooling.

(3) The oil supply path 50 is integrally formed directly below the water drain groove 36 constituting the recessed portion formed on the outer surface of the ceiling wall 33. Thus, the surface area which is exposed to outside air is increased thus enhancing heat radiation property.

(4) The plurality of piston jet branched oil passages 54 having a small diameter are formed such that the piston jet branched oil passages 54 traverse the inside of the breather device 30 downward from the oil supply path 50. Accordingly, the elevation of the oil temperature in the oil supply path 50 can be suppressed.

(5) The journal lubrication oil passage 56 from the oil supply path 50 is formed such that the journal lubrication oil passage 56 traverses the breather device 30. Thus, the journal lubrication oil passage 56 can be provided with the shortest path.

(6) The journal lubrication oil passage 56 and the piston jet branched oil passage 54 which extends toward the piston jet 53 are branched from the common oil supply path 50 in a spaced-apart manner from each other. Thus, the oil passages can be shortened and simplified.

(7) The first oil supply paths 51 and the second oil supply paths 52 are connected to the oil supply path 50. Thus, it is possible to avoid a situation where oil which is supplied to the journal 55 for the crankshaft 10 and the piston jet 53 becomes short.

(8) Oil can be supplied to a downstream side of the oil supply path 50 also from the second oil supply path 52 and hence, the shortage of oil toward the journal 55 can be avoided.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An oil passage of an internal combustion engine, the internal combustion engine, comprising:

a crankcase;

a crankshaft extending through the crankcase, the crankshaft having an axis of rotation;

a cylinder block integrally connected to the crankcase;

a piston operatively mounted within the cylinder block;

a piston jet operatively provided relative to the cylinder block for supplying oil in the internal combustion engine to the piston;

a breather device on the cylinder block wherein the breather device is in communication with an inside of the crankcase;

a recessed portion is formed in an outer surface of a ceiling wall of the breather device with an oil supply path being integrally formed on a lower side of the recessed portion, said recessed portion forming a water drain groove extending from a high point on a first side of the cylinder block, the high point having a first vertical distance from the rotational axis of the crankshaft to a low point on a second side of the cylinder block, the low point having a second vertical distance from the rotational axis of the crankshaft for draining water, the first vertical distance being greater than the second vertical distance; and wherein said oil supply path for supplying oil to the piston jet is integrally formed in the ceiling wall of the breather device wherein said ceiling wall radiates heat by being exposed to ambient air.

2. The oil passage of an internal combustion engine according to claim 1, wherein:

a plurality of cylinders mounted in the cylinder blocks are arranged such that the cylinders form a pair in the longitudinal direction and form a V-shaped bank;

the breather device is formed in a valley portion of the V-shaped bank; and the oil supply path to the piston jet is formed in the ceiling wall of the breather device.

3. The oil passage of an internal combustion engine according to claim 1, wherein a plurality of piston jet branched oil passages each having a small diameter for supplying oil to a respective piston jet are formed traversing the inside of the breather device from the oil supply path in a downward direction.

4. The oil passage of an internal combustion engine according to claim 3, wherein journal lubrication oil passage extending toward a journal for a crankshaft of the internal combustion engine is branched from the oil supply path, and traverses the inside of the breather device in a downward direction.

5. The oil passage of an internal combustion engine according to claim 4, wherein a plurality of journal lubrication oil passages extending toward the plurality of journals for the crankshaft are provided in a branched manner from the oil supply path, and a piston jet branched oil passage extending toward the piston jet is also branched from the oil supply path in a spaced-apart manner from the journal lubrication oil passage.

6. The oil passage of an internal combustion engine according to claim 5, wherein a first oil supply path for supplying oil from one end side of the oil supply path is connected to the oil supply path, and a second oil supply path having a smaller diameter than the first oil supply path is connected to a portion of the oil supply path close to the other end of the oil supply path.

7. The oil passage of an internal combustion engine according to claim 6, wherein between positions where the plurality of journal lubrication oil passages extending toward the journal from the oil supply path are branched, the second oil supply path is connected wherein the second oil supply path intersects a side portion of the oil supply path.

8. An oil passage of an internal combustion engine, the internal combustion engine, comprising:

a cylinder block;

a crankshaft extending through the cylinder block, the crankshaft having an axis of rotation;

a piston jet operatively provided relative to the cylinder block for supplying oil in the internal combustion engine to a piston;

a breather device on the cylinder block wherein the breather device is in communication with an inside of a crankcase;

a recessed portion is formed in an outer surface of a ceiling wall of the breather device with an oil supply path being integrally formed on a lower side of the recessed portion, said recessed portion forming a water drain groove extending from a high point on a first side of the cylinder block, the high point having a first vertical distance from the rotational axis of the crankshaft to a low point on a second side of the cylinder block, the low point having a second vertical distance from the rotational axis of the crankshaft for draining water, the first vertical distance being greater than the second vertical distance; and said oil supply path for supplying oil to the piston jet is integrally formed in the ceiling wall of the breather device wherein said ceiling wall radiates heat by being exposed to ambient air.

9. The oil passage of an internal combustion engine according to claim 8, wherein:

a plurality of cylinders mounted in the cylinder blocks are arranged such that the cylinders form a pair in the longitudinal direction and form a V-shaped bank;

the breather device is formed in a valley portion of the V-shaped bank; and the oil supply path to the piston jet is formed in the ceiling wall of the breather device.

10. The oil passage of an internal combustion engine according to claim 8, wherein a plurality of piston jet branched oil passages each having a small diameter for supplying oil to a respective piston jet are formed traversing the inside of the breather device from the oil supply path in a downward direction.

11. The oil passage of an internal combustion engine according to claim 10, wherein journal lubrication oil passage extending toward a journal for a crankshaft of the internal combustion engine is branched from the oil supply path, and traverses the inside of the breather device in a downward direction.

12. The oil passage of an internal combustion engine according to claim 11, wherein a plurality of journal lubrication oil passages extending toward the plurality of journals for the crankshaft are provided in a branched manner from the oil supply path, and a piston jet branched oil passage extending toward the piston jet is also branched from the oil supply path in a spaced-apart manner from the journal lubrication oil passage.

13. The oil passage of an internal combustion engine according to claim 12, wherein a first oil supply path for supplying oil from one end side of the oil supply path is connected to the oil supply path, and a second oil supply path having a smaller diameter than the first oil supply path is connected to a portion of the oil supply path close to the other end of the oil supply path.

14. The oil passage of an internal combustion engine according to claim 13, wherein between positions where the plurality of journal lubrication oil passages extending toward the journal from the oil supply path are branched, the second oil supply path is connected wherein the second oil supply path intersects a side portion of the oil supply path.

* * * * *